United States Patent [19]

Vertegaal

[11] 4,009,656

[45] Mar. 1, 1977

[54] CLOTH PRINTER AND METHOD WITH FEEDER ENGAGING WARP THREADS

[75] Inventor: Jacobus Gerardus Vertegaal, Boxmeer, Netherlands

[73] Assignee: Stork-Brabant B.V., Boxmeer, Netherlands

[22] Filed: Nov. 13, 1974

[21] Appl. No.: 523,539

[30] Foreign Application Priority Data

Nov. 14, 1974 Netherlands ..... 7415628

[52] U.S. Cl. ..... 101/129; 101/118; 226/6; 226/52; 226/193

[51] Int. Cl.[2] ..... B41F 15/24; B65H 17/38

[58] Field of Search ..... 101/115, 116, 118, 126, 101/129, 407 R, 407 BP, 407 A, 228; 26/54, 63; 28/54, 55; 226/52, 33, 19, 6, 74, 76, 170, 193; 68/5 D; 118/33

[56] References Cited

UNITED STATES PATENTS

| | | | |
|---|---|---|---|
| 1,784,459 | 12/1930 | Lipsius | 101/114 X |
| 2,217,607 | 10/1940 | Anderson et al. | 118/33 X |
| 2,297,128 | 9/1942 | Benson | 226/193 X |
| 2,676,800 | 4/1954 | Bradley | 226/33 |
| 3,140,028 | 7/1964 | Leckie | 226/53 X |
| 3,679,112 | 7/1972 | Black et al. | 226/19 |
| 3,699,885 | 10/1972 | Thierstein | 101/118 |
| 3,848,528 | 11/1974 | Seedorf | 101/126 X |
| 3,889,595 | 6/1975 | Jaffa | 101/118 X |

*Primary Examiner*—Edgar S. Burr
*Assistant Examiner*—R. E. Suter
*Attorney, Agent, or Firm*—Edmund M. Jaskiewicz

[57] ABSTRACT

A method and apparatus for printing cloths in a rotary screen printing machine comprising a number of driven cylindrical stencils, the cloths being interconnected by intermediate strips formed from uninterrupted warp threads so as to constitute a continuous web; a special feeder is mounted before the printing machine, said feeder having means cooperating with said strips, said means being synchronized with the rotation movement of said stencils.

12 Claims, 5 Drawing Figures

CLOTH PRINTER AND METHOD WITH FEEDER ENGAGING WARP THREADS

BACKGROUND OF THE INVENTION

My invention relates to a method for printing cloths which are interconnected by means of specially formed intermediate strips so as to form a continuous web. Difficulties experienced in printing this type of web have been caused by lack of uniformity sometimes occuring in the woven repeat, that is to say that the so-called "pitch" of the cloths varies. When printing cloths, one will always try to effect printing at the same location on the cloth. This is imperative for cloths to which the design to be printed should be reproductively applied relative to the woven pattern. An example are towels.

In view of the aforementioned difficulties, clothprinting has so far exclusively been effected by converting the cloths into piecegoods, such as severing the pieces of cloth one by one and by hand transferring the pieces to an intermittent flat-bed printing machine, while the correct position of each cloth is determined by one or more marks on the machine. After printing, the cloth is removed by hand and supplied to a dryer. This gives rise to more problems in the course of further treatment like fixing the pigment and washing. This known process requires very much labour and is an obstacle for achieving a great capacity per apparatus unit.

SUMMARY OF THE INVENTION

My invention in one aspect aims to provided a method by which the printing of the aforementioned web can be realized in a continuous process. This is attained by the arrangement that the uninterrupted web is continuously fed to a rotary screen printing machine having at least one driven cylindrical stencil, a feeder being provided having means cooperating with the intermediate strips of the web, the means being further synchronized with the stencils. Due to these features always one cloth will be supplied per revolution of a stencil so that the printed design will exactly coincide with the location aimed at for instance the woven pattern on the cloth.

My invention in another aspect aims to provide an apparatus of the type mentioned in the preamble, while using a continuously operating rotary screen printing machine, consisting of a frame with an endless belt following a path, while at least one cylindrical stencil is arranged on this path and a coupled drive is arranged between the belt and the stencil(s). Such a machine is known from U.S. Pat. No. 3,420,167.

It is impossible to feed the continuous web consisting of cloths, interconnected by means of specially formed intermediate strips, directly to this known rotary screen printing machine, since then inevitably a gradual shift of the printed design with respect to the woven repeat will occur. The cause thereof has already been mentioned hereinbefore and consists of that there is a (slight) irregularity in the length of the specially formed intermediate strips of the web. Consequently personal supervision during printing will always be necessary in order to intervene immediately when there is a risk of the printing design becoming slightly staggered relative to the desired location (the woven repeat).

It is a further object of my invention to provide an apparatus with which this check is no longer necessary and by which a correct positioning of the woven repeat is exclusively ensured with mechanical means. This object is attained by the arrangement that a feeder for the web is mounted on the apparatus, the feeder being provided with means which are capable of cooperation with the intermediate strips of the web, the drive of the feeder being synchronized with the drive of the screen printing machine. Due to these features each cloth is positioned anew as to the correct repeat relative to the stencil(s) of the screen printing machine, so that a gradual shift is avoided.

It should be noted that by the expression "synchronized" a fixed ratio of speed between the drive of the stencils of the screen printing machine and the drive of the feeder is meant. This fixed ratio of speed may, but needs not, be the same, i.e. a ratio 1:1.

My invention relates particularly to an apparatus for printing towels with fringes at their ends and in which consequently the aforementioned intermediate strips of the web consist of areas with warp threads only. In such an apparatus the feeder for the web consists of a pair of comb-shaped carrier members engaging the intermediate strip. A further advantage of this construction is that each carrier has not only the function of a conveyor but also serves as a straightening means for the weft threads.

The apparatus indicated hereinbefore is preferably constructed such that the velocity of the feeder is greater than the velocity of the stencil and that a downwardly inclining supporting plate is arranged between the feeder and the belt. Consequently a length of web will always be supplied which is slightly larger than the cloth length treated by the screen printing machine. Irregularities in the length of the woven repeat can thus be compensated, while the excess, if any, of the supplied web length is absorbed in the least stiff areas of the web viz. the intermediate strips with warp threads only.

SURVEY OF THE DRAWINGS

FIG. 1 shows a front view of the most important part of the apparatus;

FIG. 3 is a plan view and a side elevation of the web to be printed;

DESCRIPTION OF PREFERRED EMBODIMENTS

Figure 2:
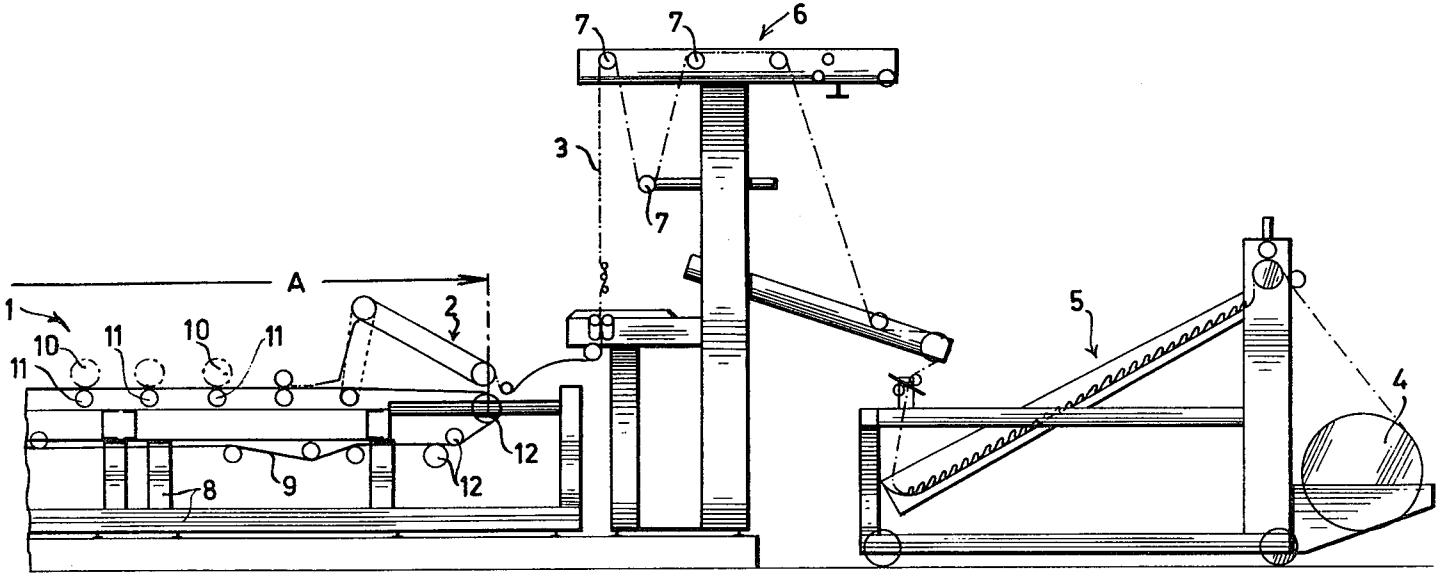
FIG. 2 shows on a larger scale the feeder from the apparatus according to FIG. 1.
Figure 2:
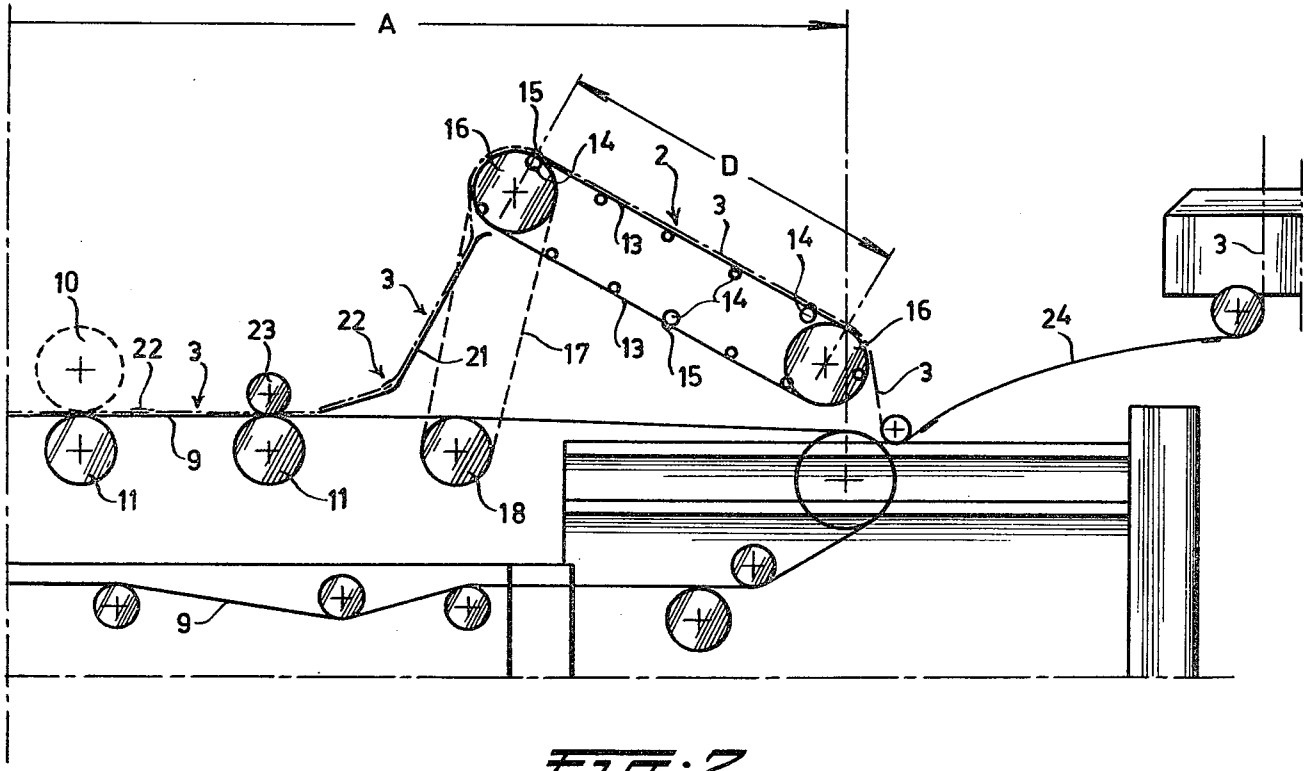

As is seen in FIG. 1 the apparatus is composed of a rotary screen printing machine 1 (only partially shown) and a feeder 2 for the web 3 to be printed. This web 3 is fed from a supply reel 4 and a buffer area 5 via a conventional device 6 provided with guide rollers 7. The screen printing machine 1 consists of a frame 8 with an endless belt 9 travelling along a path A. On this path a plurality of cylindrical stencils 10 are arranged each cooperating with the belt 9 and with a supporting roller 11 disposed thereunder. The belt is guided in the usual manner by a plurality of rollers 12. The cylindrical stencils 10 each have a drive which is coupled to the drive of the belt 9 in a manner as for example described in the U.S. Pat. No. 3,420,167.

As is shown in FIG. 2 the feeder 2 is arranged above the first part of the path A of the belt 9. This feeder is composed from some endless conveyor chains 13 (see also FIG. 4) with transverse rods 14 some of which possess a plurality of small plates 15 which are transversely mounted on the rod. The chains 13 are guided via a number of sprocket wheels 16, one of which being connected via a transmission 17 with the driving wheel 18 which is synchronized with the drive of the belt 19 and of the stencils 10 of the screen printing machine 1.

The web 3 to be printed is no homogeneous, but consists of cloths 19 which are united by means of specially shaped intermediate strips 20, so as to form a continuous web (see FIG. 3). These intermediate strips 20 consist of areas B with warp threads only, as is clearly shown in FIG. 4. After terminating the complete treatment, e.g. consisting of printing, fixing of pigment and washing, the web is converted into piece-goods and the areas B are cut into halves so that the individual cloths 19 have fringes at their ends. The intermediate strips 20 are in principle provided at fixed spacings C in the web 3. Owing to a difference in the yarn thickness and tension fluctuations produced while weaving, differences in length arise in the distance C which in the most favourable case amount to several millimeters per cloth, but which is usually more. These differences in size may cause shifting of the right place of the design to be printed on the cloths 19 by the stencils 10. This circumstance is particularly inconvenient since the design to be printed should coincide with the woven repeat of the cloth.

The feeder 2 aims particularly to compensate possible differences in size and to supply the consecutive cloths 19 to the screen printing machine 1 such that an exact repeat between the print and the cloths is ensured. For that purpose the feeder 2 is provided with the aforementioned elements 13–16 which can cooperate with the intermediate strips 20 of the web 3. The small plates 15 of the rods 14 can be considered as comb-shaped carrier members, engaging the intermediate strips 20.

The rate of feed of the feeder 2 is slightly faster than the velocity of the belt 9 and the web 3 is deposited on a downwardly inclined supporting plate 21 which is mounted between the feeder 2 and the belt 9. The chains 13 constitute on the upper side of the feeder 2, an upwardly inclined feed path D. The supporting face 21 adjoins directly the uppermost sprocket 16 of the feeder as seen in FIG. 2. The length of the feed path D is at least equal to the distance between two consecutive transverse rods 14 which have the small plates 15 (the so-called carrier rods). This distance corresponds at least to the average repeat length C of the pattern to be printed on the cloths 19. Some supporting rods 14 are arranged between these carrier rods.

Due to the synchronous drive of the feeder 2 and the screen printing machine 1 a fixed velocity ratio can be adjusted, while as mentioned in the foregoing, the velocity of the chains 13 is slightly greater than the velocity of the belt 9. Owing to this difference in velocity a loop 22 forms automatically in the web 3. This loop will come into existence in that part of the web which has the least rigidity, that is to say in the area B. The loop 22 forms in the lower part of the supporting plate 21 and this loop is subsequently squeezed additionally by a roller pair 23, 11 wherein-between the belt 9 together with the web 3 is compressed. This is attended with a temporary adherence of the web 3 to belt 9, as is customary in textile printing.

Figure 4:
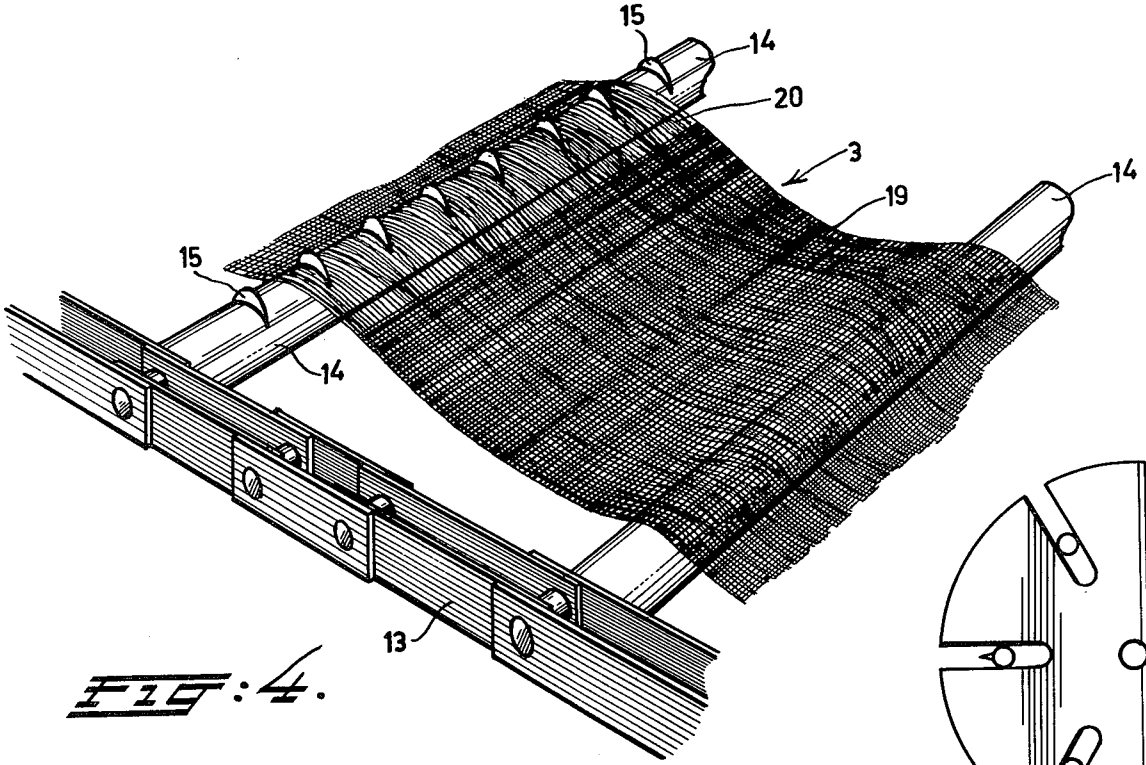
FIG. 4 is a perspective view on a still larger scale of the cooperation between the web and the feeder.
Figure 5:
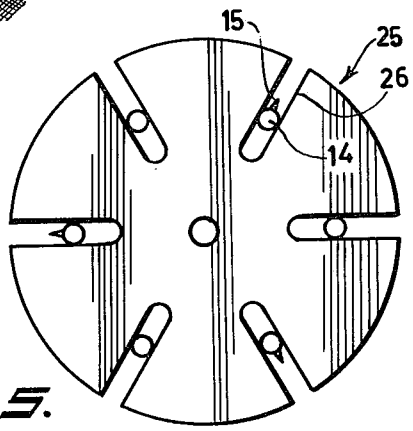

It should be noted that the comb-shaped carrier members 14, 15 of the feeder 2 have a propelling function as is clearly shown in FIG. 4. When a carrier rod 14 with plates 15 has arrived at the lefthand sprocket 16 as shown in FIG. 2, the plates 15 leave the the intermediate strip 20 and the tension on that part of web 3 is cancelled. The driving function is taken over by the next carrier rod 14 which at that moment is situated just above the lower sprocket 16. When now the distance between two consecutive rods is greater than the length C of the repeat, the second rod will, due to the greater velocity of chains 13 relative to web 3, automatically land on the intermediate strip 20. Besides their conveying function, the comb-shaped carrier members 14, 15 perform a combing functioning to serve also as weft thread straightener and ensure moreover, that the consecutive cloths 19 are supplied at square angles to the printing machine machine. The rods 14 are adjustably mounted on the chains 13, in order to vary the distance between two consecutive rods to the size C of the web to be printed. A bent plate 24, over which web 3 is passed, is disposed between the devices 2 and 6.

The stencils 10 will mostly only be used for printing the cloths 19 without the fringes of the intermediate strip 20. For that purpose part of the circumference of the stencil 10 is preferably not provided with a design. This part coincides with the passage of the strips 20, during operation of the apparatus. It is characteristic for the apparatus that the length C of the woven pattern of the cloths 19 is longer than the circumference of the stencils 10. The comb-shaped carrier members 14, 15 acting as conveying rods also serving as weft thread straightener, exactly direct the cloths 19 relative to the stencils 10. The rest of the supplied material is absorbed due to the formation of a loop 22 in the part not to be printed of the web 3, the loops being fixed by the pair of rollers 23, 11.

Figure 5:
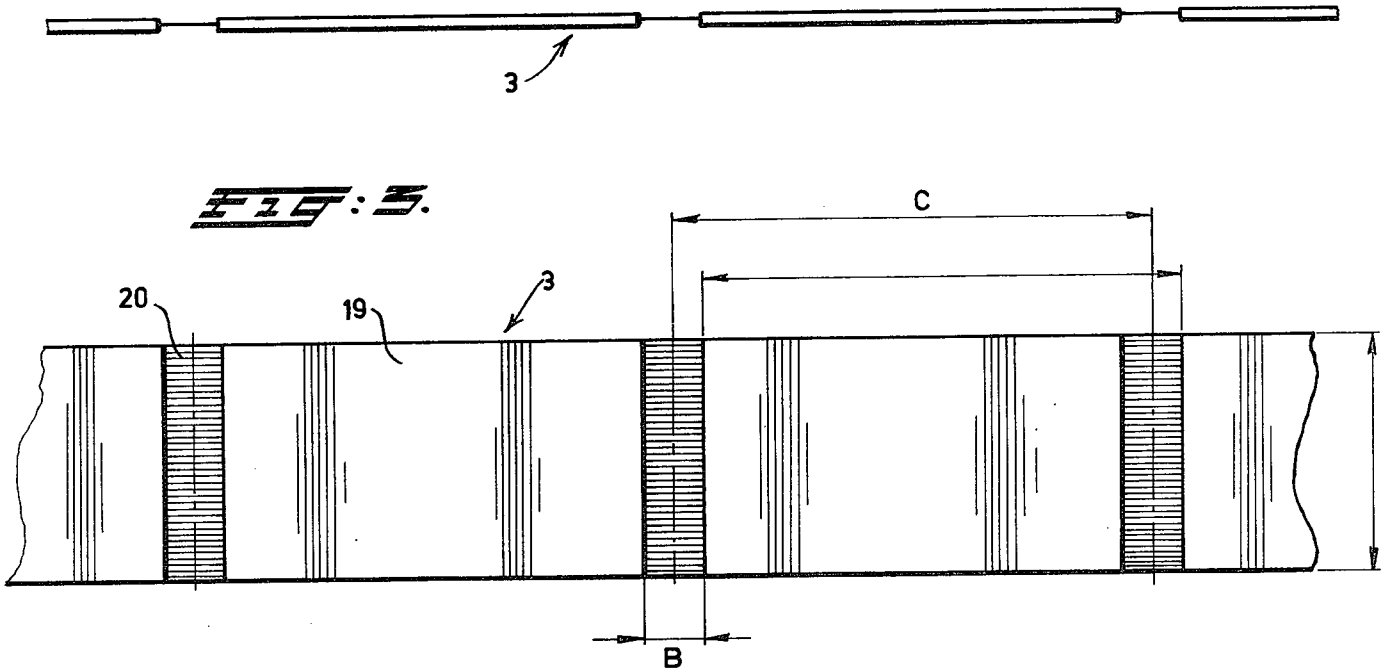
FIG. 5 is a modification of the feeder according to FIG. 2.

An interesting modification of the feeder depicted in FIGS. 1 and 2 is shown in FIG. 5. This embodiment consists of some circular discs 25 provided with a plurality of radial slits 26. In each pair of slits a rod 14 is guided, while some of these rods are furnished in the manner as indicated, with plates 15. Due to a radial adjustment of the rods 14 the distance between two consecutive carrier rods can be adapted to the length C of the web 3, which extends between the repeat.

What I claim is:

1. An apparatus for printing cloths which are interconnected by intermediate strips consisting of warp threads to define a continuous web having a woven repeat comprising a rotary screen printing machine having an endless belt movable along a path, a rotatable cylinder stencil having a print pattern thereon less than the circumference of said stencil and positioned on the path to print the web moved along said path by the endless belt, the belt and stencil being drivingly connected, feeder means for feeding said continuous web to said rotary screen printing machine, said feeder means including means projecting between the warp threads and thereby engaging the intermediate strips of said web, and means for driving said feeder means in synchronism with the movable endless belt of the rotary screen printing machine at a fixed speed ratio greater than one so that a length of the web advanced by said feeder means is slightly longer than the length of the print pattern on the rotatable stencil whereby any irregularities in the length of the woven repeat in the cloths and intermediate strips are compensated.

2. An apparatus according to claim 1 and further comprising means between said feeder means and said endless belt upon which the fed web is deposited from said feeder means for forming a loop in the intermediate strips of the web to absorb any excess in the fed web.

3. An apparatus according to claim 2 wherein said loop forming means comprises an inclined supporting plate between the feeder means and the belt to receive the fed web.

4. An apparatus according to claim 3 wherein a pair of rollers are disposed on both sides of the path of the belt at the end of the supporting plate adjacent the belt, the belt with the web being squeezed between said rollers.

5. An apparatus according to claim 4, wherein said feeder means further comprises two endless conveyor chains defining upper and lower reaches and having a plurality of transverse rods, certain ones of said rods having a plurality of small plates which are mounted transversely on each certain rod, the chains being guided over a plurality of sprockets.

6. An apparatus according to claim 5, wherein the upper reaches of the conveyor chains define an inclined feed path having a supporting face directly adjoining the sprocket of the feeder at the uppermost end of the inclined feed path.

7. An apparatus according to claim 6, wherein the length of the feed path of the feeder means being at least equal to the distance between two consecutive transverse rods with small plates, said distance being at least equal to the length extending between the said woven repeat.

8. An apparatus according to claim 1 wherein the feeder means for the web comprises a set of carrier members having teeth-like projections which engage the intermediate strips.

9. An apparatus according to claim 1, wherein the feeder means comprises a plurality of discs provided with a plurality of radial splits in which rods are secured, some of said rods having a plurality of plates mounted transverse to the rods.

10. An apparatus according to claim 9 wherein said rods are adjustably secured in said radial slits in the disks.

11. A method for printing cloths which are interconnected by intermediate strips consisting of warp threads so as to form a continuous web having a woven repeat, the steps of feeding the web continuously to a rotary screen printing machine having an endless belt moving along a path and at least one cylindrical stencil positioned on the path and driven at a predetermined rotary speed, the stencil having a print pattern thereon less than the circumference of the stencil, applying a driving force to the intermediate strips to feed the web to the printing machine at a fixed speed ratio greater than one with respect to the speed of the moving endless belt such that a length of the web advanced by the driving force is slightly longer than a length of the web printed by the rotatable stencil whereby any irregularities in the length of the woven repeat are compensated.

12. A method for printing cloths according to claim 11 and forming a loop in the intermediate strips of the web before the fed web is deposited at the printing machine so as to absorb any excess in the supplied web.

* * * * *